US011771937B2

(12) United States Patent
Abels et al.

(10) Patent No.: US 11,771,937 B2
(45) Date of Patent: Oct. 3, 2023

(54) FIRE PROTECTION SPRINKLER ASSEMBLY

(71) Applicant: Tyco Fire Products LP, Lansdale, PA (US)

(72) Inventors: Bernhard Abels, Tallahassee, FL (US); Manuel R. Silva, Jr., Cranston, RI (US); Mathew R. Ancone, Warwick, RI (US)

(73) Assignee: Tyco Fire Products LP, Cranston, RI (US)

( * ) Notice: Subject to any disclaimer, the term of this patent is extended or adjusted under 35 U.S.C. 154(b) by 72 days.

(21) Appl. No.: 17/331,359

(22) Filed: May 26, 2021

(65) Prior Publication Data

US 2021/0275848 A1 Sep. 9, 2021

Related U.S. Application Data

(63) Continuation of application No. 16/017,744, filed on Jun. 25, 2018, now Pat. No. 11,020,622, which is a (Continued)

(51) Int. Cl.
*A62C 35/68* (2006.01)
*A62C 31/28* (2006.01)
(Continued)

(52) U.S. Cl.
CPC ..... *A62C 35/68* (2013.01); *A62C 31/28* (2013.01); *A62C 37/09* (2013.01); *B05B 15/65* (2018.02); *Y10T 29/49826* (2015.01)

(58) Field of Classification Search
CPC ..... A62C 35/60; A62C 35/62; A62C 35/64; A62C 35/68; A62C 3/0292;
(Continued)

(56) References Cited

U.S. PATENT DOCUMENTS 3,489,437 A * 1/1970 Duret ..... F16L 15/004 285/55
3,768,777 A * 10/1973 Hechler, IV ..... F16K 1/36 251/319
(Continued)

FOREIGN PATENT DOCUMENTS

WO WO-2008/067421 A2 6/2008
WO WO-2010/141948 A1 12/2010
WO WO-2013/010098 A2 1/2013

OTHER PUBLICATIONS

IFW, U.S. Appl. No. 61/457,942, filed Jul. 13, 2011, 318 pages.
(Continued)

*Primary Examiner* — Cody J Lieuwen
(74) *Attorney, Agent, or Firm* — Foley & Lardner LLP

(57) ABSTRACT

A sprinkler assembly (10) having a receiving member (12), a fluid tight seal (44) and a sprinkler frame (14). The receiving member includes an inner surface (22) defining an internal passageway and a central axis (A-A) of the assembly. The frame of the sprinkler includes an internal surface (38) that defines a fluid passage. The sprinkler assembly includes cooperating positioning elements (28, 40) which engage and couple the sprinkler frame to the receiving member for at least one of an axial and rotational adjustment between the frame and receiving member. The engaged positioning elements facilitate formation or location of the fluid tight seal between the sprinkler frame and receiving member, the seal being spaced from the engaged positioning elements. In one aspect of the assembly, the sprinkler frame and receiving member are made of plastic material (e.g. CPVC).

17 Claims, 5 Drawing Sheets

Related U.S. Application Data continuation of application No. 14/124,981, filed as application No. PCT/US2012/046717 on Jul. 13, 2012, now Pat. No. 10,010,730.

(60) Provisional application No. 61/457,942, filed on Jul. 13, 2011.

(51) Int. Cl.
*A62C 37/09* (2006.01)
*B05B 15/65* (2018.01)

(58) Field of Classification Search
CPC ... A62C 37/08–16; A62C 31/02; A62C 31/28; B05B 15/65; Y10T 29/49826
USPC ..... 169/37–41, 57, 90, DIG. 3; 239/518; 285/33
See application file for complete search history.

(56) References Cited

U.S. PATENT DOCUMENTS 4,007,877 A * 2/1977 Jackson ..... B05B 15/658 239/281
5,002,318 A 3/1991 Witter
5,094,298 A 3/1992 Polan
5,109,929 A * 5/1992 Spears ..... F16L 47/24 169/37
5,921,322 A 7/1999 Bonfield et al.
6,866,305 B2 3/2005 Spears
6,868,916 B2 3/2005 Petersen
7,516,800 B1 4/2009 Silva et al.
2003/0196821 A1 10/2003 Kikuchi et al.
2004/0040518 A1 3/2004 Lowe et al.
2005/0236166 A1 10/2005 Bentzien et al.
2010/0176258 A1 7/2010 Oh
2010/0252282 A1 10/2010 Sarkisyan et al.
2010/0259042 A1* 10/2010 Spears ..... F16L 15/02 285/379
2010/0263883 A1 10/2010 Abels et al.
2011/0186653 A1* 8/2011 Cai ..... B05B 1/16 239/548
2011/0214886 A1 9/2011 Orr
2013/0319697 A1 12/2013 Pahila et al.
2014/0096981 A1* 4/2014 Ringer ..... A62C 35/62 169/17

OTHER PUBLICATIONS

International Search Report and Written Opinion on PCT/US2012/046717, dated Sep. 20, 2013, 13 pages.
Tyco Fire & Building Products Technical Data Sheet TFP1915: "Blazemaster CPVC Sprinkler Pipe and Fittings Submittal Sheet" (Jun. 2008), 2 pages.

* cited by examiner

FIRE PROTECTION SPRINKLER ASSEMBLY

CROSS-REFERENCE TO RELATED PATENT APPLICATIONS

This application claims priority under 35 U.S.C. § 120 as a continuation of U.S. patent application Ser. No. 16/017,744, filed Jun. 25, 2018, which is a continuation under 35 U.S.C. § 120 of U.S. patent application Ser. No. 14/124,981, filed Aug. 11, 2014, which is a nationalization under 35 U.S.C. § 371 of International Patent Application No. PCT/US2012/046717, filed Jul. 13, 2012, which claims priority under 35 U.S.C. § 119 to U.S. Provisional Patent Application No. 61/457,942, filed Jul. 13, 2011, each of which is hereby incorporated by reference in its entirety. International Patent PCT Publication No. WO2008/067421 and International Patent PCT Publication No. WO2010/141948 are incorporated by reference in their entireties by reference thereto.

TECHNICAL FIELD

The present invention relates generally to fire protection devices, and more specifically, sprinkler assemblies, their components and method of their assembly.

DISCLOSURE OF INVENTION

Embodiments of the present invention provide for sprinkler assemblies, their components and methods of installation. More specifically, preferred embodiments of the sprinkler assembly include a fire protection sprinkler and a receiver component for coupling the sprinkler to a fluid supply pipe in which the assembly has a coupling arrangement that allows for axial and/or rotational adjustment between the sprinkler and the receiver. A fluid tight seal is formed adjacent and more particularly spaced from the coupling arrangement of the assembly. In one preferred embodiment of the assembly, the sprinkler includes a sprinkler frame and a receiver member each made of a plastic material. A preferably plastic embodiment of the sprinkler frame is configured to support operational components of the sprinkler within a chamber of the sprinkler frame in an unactuated state of the sprinkler.

In one particular preferred embodiment of the sprinkler assembly, the receiver component preferably includes a tubular member having a proximal end for coupling to a fluid supply system and a distal end for engaging the sprinkler. The preferred tubular member includes an inner surface that defines an internal passageway and central longitudinal axis of the assembly. The tubular member further includes a first positioning element and a sealing surface. The preferred assembly has a sprinkler that includes a sprinkler frame with one end engaged with the tubular member and another end coupled to a fluid deflector. The sprinkler frame includes an internal surface and an external surface, in which the inner surface preferably defines a fluid passage and a chamber in communication with the fluid passage. The sprinkler frame includes a second positioning element engaged with the first positioning element of the tubular member to couple the sprinkler frame to the tubular member for at least one of axial and rotational adjustment between the tubular member and the sprinkler frame. A fluid tight seal formed between the tubular member and the sprinkler frame is axially spaced from the engaged first and second positioning elements.

As used herein, "positioning element" refers to a mechanism(s) of one component which engages and cooperates with a complimentary mechanism of another component to couple the components together and provide adjustable relative rotational and/or axial movement or orientation between the two components. The positioning elements of the subject sprinkler assemblies preferably include any one of: (i) complimentary first and second threads; (ii) complimentary tabs and shelf formation; (iii) complimentary projection and recess. In one particular embodiment of the assembly, the preferred positioning elements provide for cooperating internal and external threads that are American Standard straight pipe threads (NFS) to provide for at least one of axial or rotational adjustment between the sprinkler frame and the receiver component. The preferred fluid tight seal includes a seal member, such as for example an o-ring, preferably disposed in a groove formed in the external surface of the sprinkler frame and in sealing contact with the internal sealing surface of the receiver component. In another preferred aspect of the subject assemblies, the engagement of the positioning elements facilitates formation or axially locates the seal assembly between the receiver and sprinkler frame.

Another embodiment of the sprinkler assembly provides that the internal surface of a preferably plastic sprinkler frame that defines the sprinkler chamber includes a metallic ring embedded in the internal surface. A deflector assembly is preferably coupled to the frame so as to have a first position disposed within the chamber and a second position preferably external and spaced distally of the chamber. A thermally responsive closure assembly supports the deflector assembly in its first position in an unactuated state of the sprinkler. The closure assembly preferably includes a thermally responsive plate assembly and a lever member to support the deflector assembly in its first position within the chamber. In one preferred embodiment, a first end of the lever member is engaged with the plate assembly and a second end is engaged with the metallic ring. In an alternate embodiment, the deflector assembly is coupled to a preferred sprinkler frame at fixed distance from the outlet of the sprinkler frame.

The preferred embodiments of the sprinkler assembly and its components provide for a method of installing a sprinkler frame. The method includes engaging the threaded portion of the sprinkler frame with an internal thread of a receiver member having an internal sealing surface spaced from the internal thread; axially or rotationally adjusting the frame and the receiver member with respect to one another; and disposing the sealing member along the internal sealing surface with the engaged external and internal threaded portion to form a fluid tight seal between the receiver member and the sprinkler frame. The preferred coupling arrangements between the sprinkler frame and receiver provide that the threaded portions can be engaged without using an installation tool.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1:
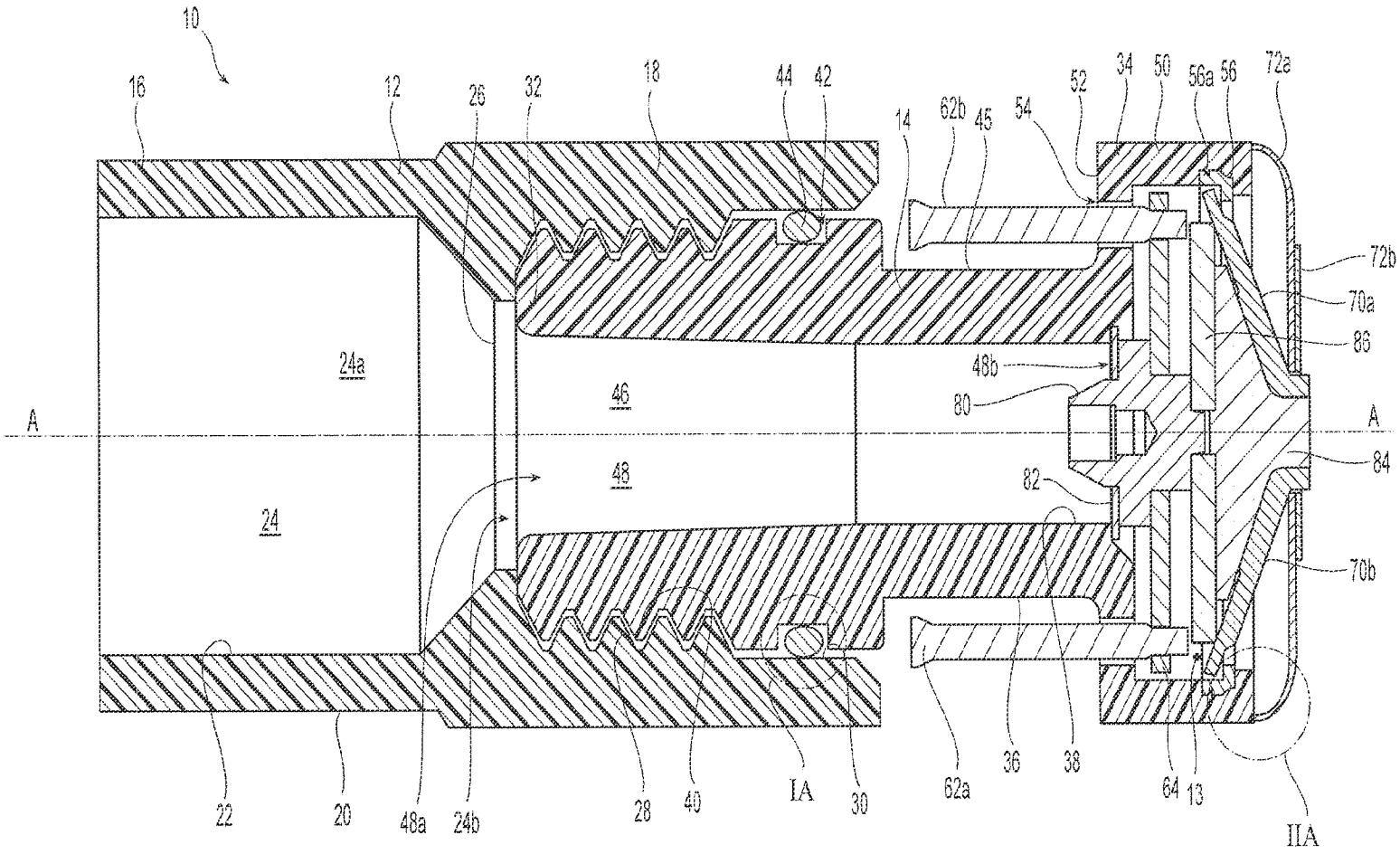
FIG. 1 is a cross-sectional view of a preferred fire sprinkler assembly.

Shown in FIG. 1 is a first illustrative embodiment of a preferred fire protection sprinkler assembly 10. The preferred assembly 10 includes a receiving component or member 12 and a sprinkler frame component 14 disposed within the receiver 12. The preferred assembly 10 includes a coupling arrangement and a fluid tight seal between the receiver 12 and the sprinkler frame 14. The preferred coupling and sealing arrangements shown and described herein provide for the fluid tight seal and relative axial and/or rotational adjustment between the components 12, 14. The receiver component 12 preferably serves as a coupling element for installing the sprinkler 10 in a fluid supply piping network of a fire protection system. The sprinkler assembly 10 may be configured may be configured as either a concealed pendent or a sidewall sprinkler in which, the sprinkler frame 14 preferably includes a chamber 13 for housing and supporting operational components of a fire protection sprinkler, such as for example, i) a closure assembly; ii) a fluid deflecting assembly; and iii) a thermally responsive trigger assembly. Alternatively, the sprinkler assembly 10 may be configured as a pendent or sidewall sprinkler having a deflector assembly at fixed distance from the sprinkler frame. Accordingly, the sprinkler assembly may include a telescopic or non-telescopic deflector assembly.

Figure 2A:
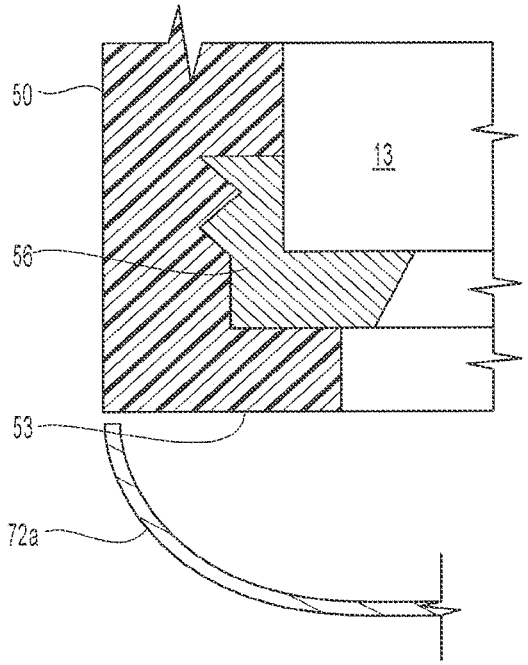
FIG. 2A is a detailed cross-sectional view of a preferred sprinkler frame used in the assembly of FIG. 1.

Examples of particular embodiments of preferred closure, fluid deflecting and trigger assemblies are further described in greater detail in International Patent Publication No. WO2010/141948. For example, i) the closure assembly, shown and described in WO2010/141948 at paragraph nos. [0043]; FIGS. 1, 2 and 2A; ii) a fluid deflecting assembly, shown and described in WO2010/141948 at paragraph nos. [0042]-[0045], FIGS. 2, 2E; [0090]-[0099], FIGS. 4-6B; [0106]-[0111]; FIGS. 8A-10A; and iii) a thermally responsive trigger assembly, shown and described in WO2010/141948 at paragraph nos. [0045]-[0090]; FIGS. 2-2D.

The sprinkler assembly 10 preferably defines a total axial length of about 3.5 inches. However, the assembly can be lengthened or shortened by preferably elongating or shortening the axial length of the receiver component 12. Alternatively, the sprinkler frame 14 may be lengthened or shortened as well. The axial length of the receiver component preferably ranges from about two inches (2 in.) to about three inches (3 in.). FIG. 1 shows the components 12, 14 assembled, but in use, the components 12, 14 are preferably separate and only coupled together upon installation in the fire protection system.

The receiver 12 includes a first end 16 that is preferably configured to coupling to an end of a pipe or pipe fitting of a fluid supply line in the piping network. In a preferred installation, a fire protection contractor or installer preferably affixes the first end of the receiver 12 to the fluid supply pipe or pipe fitting. With the receiver 12 coupled to the piping network, the fire protection contractor or installer preferably couples the sprinkler frame 14 and the remainder of the sprinkler assembly to the receiving or second end 18 of the receiver component 12. The preferred assembly 10 provides for a coupling arrangement that allows the sprinkler frame and receiver components 14, 12 to be coupled together in a fluid tight manner by hand, i.e., without the use of a separate installation tool. Moreover, the preferred coupling arrangement provides that the axial and/or rotational relationship between the component 12, 14 is adjustable while maintaining a fluid tight seal between the receiver 12 and the sprinkler frame 14.

The receiver component 12 is a tubular, preferably circular tubular member having an external surface 20 and an internal surface 22. More preferably, the receiver component 12 is configured as a straight pipe nipple. The receiver 12 may be alternatively configured to have a bend, such as for example, as an elbow fitting. As noted above, the receiver component 12 is configured to couple the sprinkler assembly 10 to a piping network. Accordingly, the first end 16 of the component 12 is dimensioned and configured for engagement with a pipe or pipe fitting of a fluid supply piping network. For example, the first end 16 can be a male pipe end configured either one of a mechanical or chemical bond to the fluid supply pipe or pipe fitting.

The internal surface 22 forms an internal passageway 24 that extends from the first end 16 to the second end 18 of the receiver component 12. The internal passageway 24 further defines a central longitudinal axis A-A of the sprinkler assembly 10 and includes a proximal portion 24*a* and a distal portion 24*b*. The proximal portion 24*a* defines a fluid inlet of the assembly for receiving a fire fighting fluid, preferably water, from the piping network to which the receiver component 12 and associated fire protection sprinkler are coupled. The inner surface 22 of the proximal portion 24*a* preferably provides the internal passageway 24 with an initially substantially constant diameter in the distal direction which then tapers radially inwardly toward the central axis A-A so as to define a conical portion of the proximal portion 24*a* of the passageway 24. However, the passageway could be defined by, for example, alternative combinations of variable and/or constant diameters or other cross-sectional geometries, such as for example, rectangular. The tapering inner surface 22 further preferably forms an interior shoulder 26 of the receiver component 12 which divides the passageway 24 into the proximal portion 24*a* and distal portion 24*b*. The preferred conical geometry of the proximal portion 24*a* of the passageway 24 funnels incoming fluid into the sprinkler frame 14 disposed within the distal portion 24*b* of the internal passageway 24 of the receiver component 12.

The distal portion 24*b* of the passageway 24 of the receiver 12 is configured to receive and engage the sprinkler frame 14. More particularly, the receiver component 12 and sprinkler frame 14 include complimentary positioning elements that engage one another to couple the components together with axial and/or rotational adjustment to facilitate and/or locate a fluid tight seal between the components. For the sprinkler assembly 10 and receiver 12, the inner surface 22 of the distal portion 24*b* preferably includes a positioning element in the form of an internal thread 28 for engagement with a preferably corresponding mating external thread of the sprinkler frame 14. The inner surface 22 further defines a segment of the distal portion 24*b* passageway 24 having a preferably constant diameter so as to form an axially extending sealing surface 30 which engages a sealing element disposed between the sprinkler frame 14 and the sealing surface 30 to form the fluid tight connection between the components 12, 14. The sealing surface is preferably distal of the internal thread 28. Alternatively, the sealing surface could be formed proximal of the internal thread 28. To facilitate receipt of the sprinkler frame 14 into the distal portion 24*b* of the passageway 24, the inner surface 22 further preferably includes a chamfer at the second end 18 of the receiver component 12.

Figure 1A:
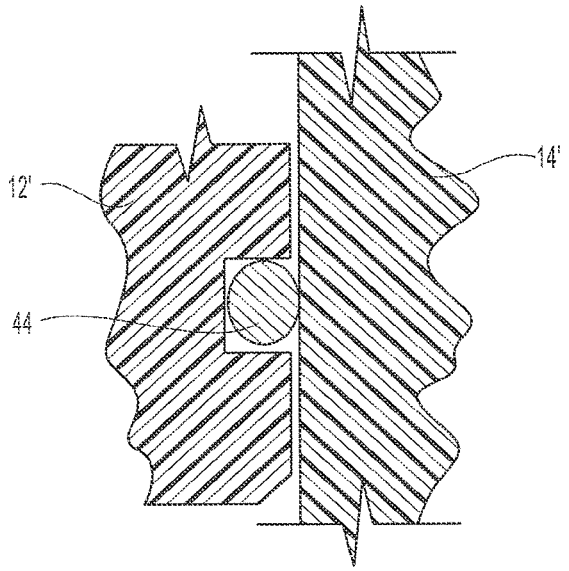
FIG. 1A is a detailed cross-sectional view of coupling arrangement for use in the assembly of FIG. 1.

The sprinkler frame 14 has a first end 32 at an enlarged proximal portion of the frame 14 and a second end 34 at a preferably larger distal portion of the frame 14. The frame 14 includes an external surface 36 and an internal surface 38. Along the proximal portion of the frame, the external surface 36 preferably includes a positioning element in the form of an external thread 40 that mates with the internal thread 28 of the receiver component 12. Preferably each of the external thread 40 and internal thread 28 are straight pipe threads such as for example, American Standard straight pipe thread (NPS) or cylindrical threads such as for example, Whitworth-pipe thread acc. DIN/ISO 228. Further preferably circumscribed about the proximal portion of the external surface 36 is a recess or groove 42 having a groove depth and axial length. The groove 42 is preferably located distally of the external thread 40, and is preferably dimensioned and configured to house a sealing member 44, preferably an o-ring or other gasket. The groove 42 provides for one or more sealing surfaces including a surface extending preferably parallel to the assembly axis A-A that for sealed engagement with the o-ring. However other configurations of the groove 42 can be used such for example a semicircular groove. The engagement between the external thread 40 of the frame 14 and the internal thread 28 of the receiver component 12 provide the sprinkler assembly 10 with positioning elements to locate the sealing member 44 into engagement with the sealing surface 30 of the receiver component 12 to form the fluid tight connection between the receiving and sprinkler frame components 12, 14. The axial length of the sealing surface 30 is preferably greater than the axial length of the groove 42. The interior shoulder 26 of the receiver component 12 preferably acts as a stop to limit the axial progression of the frame 14 within the receiver component 12 in the proximal direction. In an alternate arrangement, as seen in FIG. 1A, the internal surface of the receiver 12' may include an internal groove to provide a housing for the sealing member 44 and the external surface of the sprinkler frame 14' may provide the sealing surface to form the fluid tight seal with the sealing member 44 upon coupling the receiver and sprinkler frame 12', 14' together.

The installation of the preferred fire protection sprinkler 10 device would preferably provide that the receiver component 12 and sprinkler frame 14, along with the associated operational components, are initially separated and then coupled together in the field by the contractor or installer. Although the sprinkler assembly 10 may be a provided as complete assembly for installation in the fluid pipe network. The preferred straight pipe thread engagement between the receiver 12 and frame 14 eases the installation process for the contractor/installer because the fluid tight connection between the components 12, 14 does not rely on a properly torqued tapered threaded seal arrangement. Instead, a fluid tight connection is made so long as the preferred sealing member 44 is located and maintained along the sealing surface 30 of the receiver component 12. Accordingly, the components can be coupled together directly by hand so as to eliminate the need for an installation tool, such as for example, a torque wrench.

Moreover, the straight thread arrangement 28, 40 with separate sealing member 44 allows for relative adjustment between the components 12, 14. In particular, because the fluid tight seal between the components 12, 14 is not dependent upon the threaded engagement, the relative position between the two components 12, 14 can be adjusted provided the sealing member is located and maintained along the internal sealing surface 30 of the receiver component 12. The relative axial position between the components 12, 14 can be adjusted by the positioning elements of straight threads 28, 40 such that the first end 32 of the sprinkler frame 14 is positioned closer or further from the interior shoulder 26 of the receiver component 12 as is needed. The shoulder 26 provides a stop surface or limit to the axial movement of the sprinkler frame 14 in the proximal direction relative to the receiver 12. Additionally, the relative angular orientation between the receiver and sprinkler frame 12, 14 about the central axis A-A can also be adjusted. For example, in the case of where the sprinkler assembly 10 is being installed as a sidewall fire protection sprinkler device, the orientation of the deflector 64 may have to be adjusted at the time of installation. If the receiver component 12 is affixed to a plastic or CPVC pipe fitting, the installer can engage the sprinkler frame 14 with the receiver 12 and rotationally adjust the frame about the axis B-B in order to properly orient the sidewall deflector relative to a desired reference such as, for example, the floor.

Accordingly, the straight pipe thread coupling arrangement 28, 40 in combination with the separate sealing member 44 provides a means by which to couple the receiving and sprinkler frame components 12, 14 in a fluid tight manner and provide for the adjustment of the components relative to one another axially and/or rotationally about the central axis A-A. In the embodiment of the sprinkler assembly 10 shown in the FIG. 1, the tubular receiver component 12 and the sprinkler frame 14 provide a continuous structure about the assembly axis A-A. In alternate embodiments, the either one of the receiver 12 or sprinkler frame 14 components may be discontinuously formed about its axis. Moreover, either one of the coupling threads 28, 40 may be discontinuously formed so as to be discontinuous about the central axis A-A of the sprinkler assembly 10. For the preferred threaded coupling arrangements, whether formed continuously or discontinuously, the cooperating the threads 28, 40 and the component bodies are sufficiently rigid to effect the threaded engagement.

Figure 4A:
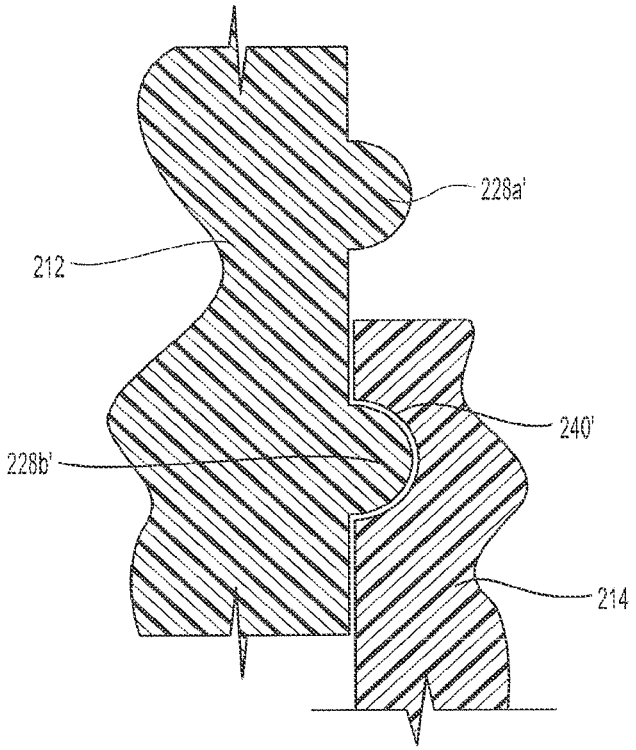
FIG. 4A is a detailed cross-sectional view of a preferred arrangement of positioning elements for use in the assembly of FIG. 4.
Figure 3:
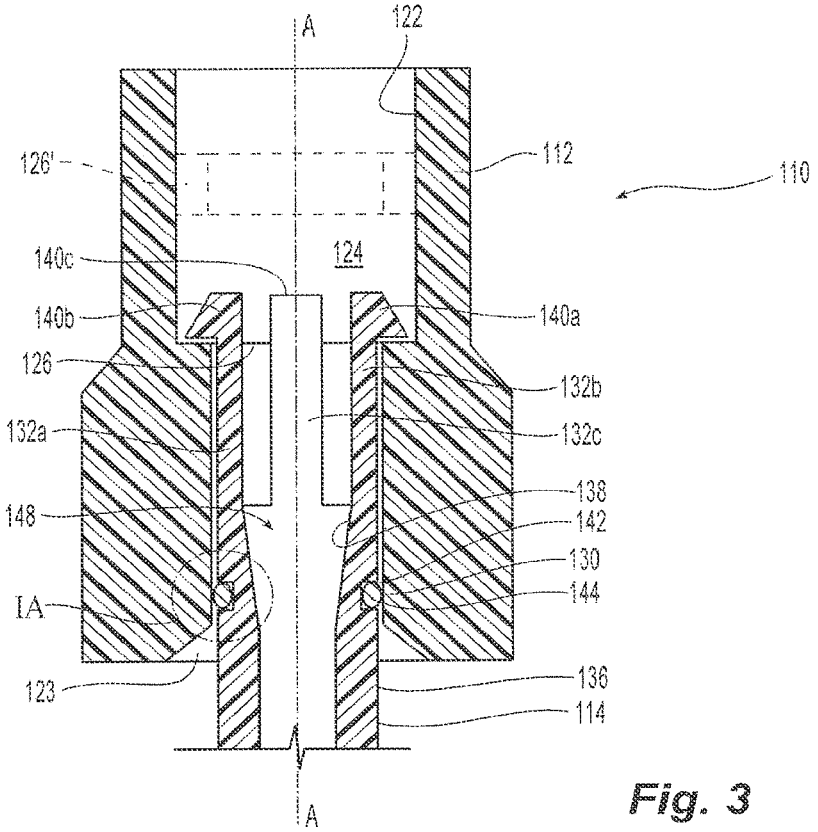
FIG. 3 is a detailed cross-sectional view of another embodiment of a coupling arrangement and sealing assembly of a sprinkler assembly.
Figure 4:
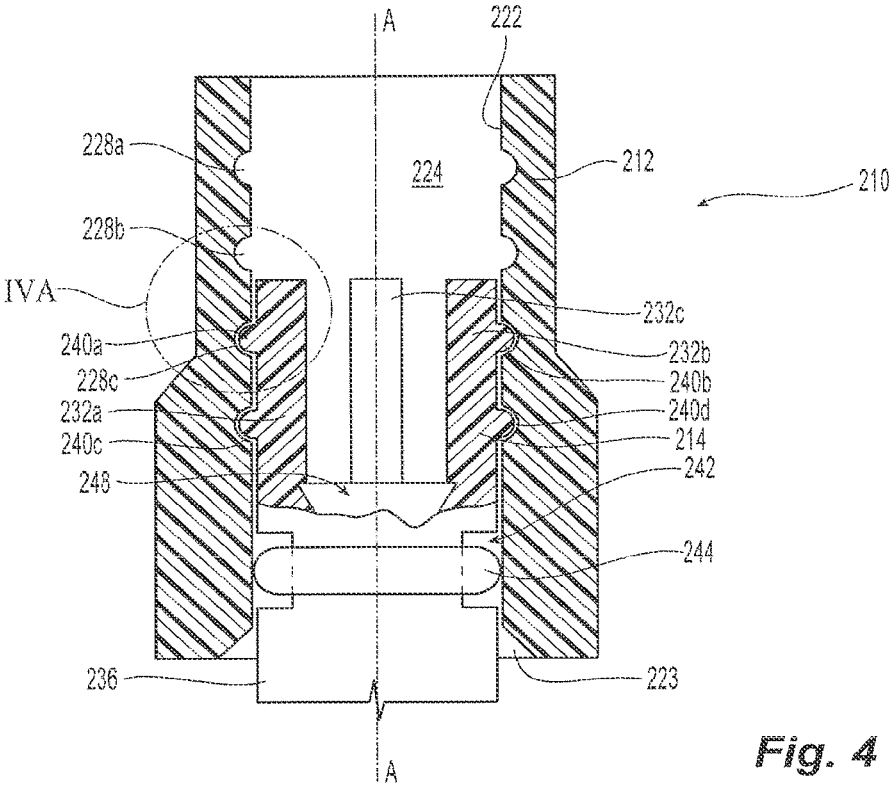
FIG. 4 is a detailed cross-sectional view of another embodiment of a coupling arrangement and sealing assembly of a sprinkler assembly.

Alternative coupling arrangements and positioning elements can be used provided that they locate and maintain the sealing member 44 along the internal sealing surface 30 of the receiving conduit 12 in order to provide a fluid tight seal and prevent the components 12, 14 from disengaging from one another, preferably under a static fluid pressure of at least 500 psi., and yet allow the relative axial and/or rotational position between the components 12, 14 to be adjusted. Alternative coupling arrangements are shown in FIGS. 3 and 4. More specifically, one or both of the components may include one or more positioning elements to provide the axial and/or rotational adjustment between the components while locating or facilitating the formation of the fluid tight seal.

Shown in FIG. 3 is an alternate sprinkler assembly 110 having a receiver component 112 coupled to a sprinkler frame 114. The receiver component 112 preferably couples the sprinkler of the assembly 110 to a fluid supply network as described above. The receiver component 112 includes an inner surface 122 which defines an internal passageway 124 of the receiver. The inner surface 122 further preferably defines a positioning element 126 for cooperative engagement with a positioning element 140 of the sprinkler frame 114. More preferably, the inner surface 122 defines a shelf 126 which circumscribes the assembly axis A-A and is engaged by the positioning element of the sprinkler frame 114 to couple the receiver 112 and frame 114 together. In one preferred embodiment, two or more positioning elements 140 are formed at a proximal end of the sprinkler frame 114. More specifically, the proximal portion of the sprinkler frame 14 is discontinuously formed to provide a plurality of segmented members or legs 132 *a*, 132*b*, 132*c* radially spaced about the central axis of the assembly 110. The legs 132*a*, 132*b*, 132*c* are further preferably formed so as to be substantially resilient to provide resilient deflection toward or away from the assembly axis A-A. The positioning elements 140*a*, 140*b*, 140*c* are preferably unitarily formed with the proximal ends of the legs 132*a*, 132*b*, 132*c*. Each of the positioning elements are preferably formed as tabs which project radially outward to form a notch with its associated leg for engaging the shelf 126 of the inner surface 122 of the receiver 112 to couple the sprinkler receiver 112 and the frame 114.

In the assembly of the sprinkler 110, the legs 132*a*, 132*b*, 132*c* are inserted into distal end of the receiver passageway 124. A chamfer 123 can be formed at the distal end of the receiver to compress the legs 132*a*, 132*b*, 132*c* radially inward. To further facilitate radial compression and axial movement of the proximal end of the frame 114 through the chamfered outlet and passageway 124 of the receiver, the tabs 140*a*, 140*b*, 140*c* preferably include an inclined engagement surface. The frame 114 is further inserted into the receiver to permit the tabs 140*a*, 140*b*, 140*c* to radially expand such that the tabs and notch formed between the tabs and the legs 132*a*, 132*b*, 132*c* engage the shelf 126 and couple the receiver 112 and sprinkler frame 114 together. The engagement of the shelf 126 and the tabs 140 provides for relative rotational adjustment between the receiver and frame components 112, 114. Two or more shelves 126' may be formed along the inner surface 122 of the receiver 112 to provide multiple positioning elements for engagement by the frame 114 to provide for axial adjustment, in at least one axial direction.

The shelf 126 is axially located and formed along the inner surface 122 such that the engagement of the positioning elements 126, 140 between the receiver 112 and the sprinkler frame 114 facilitates formation of a fluid tight seal between components 112, 114. More preferably, the external surface 136 of the sprinkler frame 114 includes a groove formation 142 to house a sealing member 144, such as for example an o-ring. The groove 142 is preferably axially located along the external surface 136 such that the when the tabs 140*a*, 140*b*, 140*c* engage the shelf 126, the seal member 144 engages a sealing surface 130 of the receiver to form the fluid tight seal. In an alternate configuration of the seal assembly, the inner surface 122 of the receiver 112 may define an internal groove for housing the seal element 144 and the external surface 136 of the sprinkler frame 114 may include a sealing surface for engagement with the seal element 144 to form the fluid tight seal. An exemplary illustration of the alternate sealing configuration is shown in FIG. 1 A.

Shown in FIG. 4 is another embodiment of the sprinkler assembly 210 which provides for an alternate coupling arrangement to provide for axial and/or rotational adjustment between the receiver component 212 and sprinkler frame 214 and facilitate formation of the fluid tight seal between the components 212, 214. The receiver 212 includes an inner surface 222 that defines an internal passageway 224 and one or more positioning elements 228 for engagement with a complimentary positioning element 240 of the sprinkler frame 214. Preferably, the inner surface 222 defines one or more depressions or recesses 228*a*, 228*b*, 228*c* and more preferably defines a plurality of axially spaced radiused grooves that either completely or partially circumscribe assembly axis A-A. In the embodiment shown, the sprinkler frame 212 preferably includes two or more positioning elements 240 formed at a proximal end of the sprinkler frame 214. More specifically, the proximal portion of the sprinkler frame 214 is discontinuously formed to provide a plurality of segmented members or legs 232*a*, 232*b*, 232*c* radially spaced about the central axis of the assembly 210. The legs 232*a*, 232*b*, 232*c* are further preferably formed so as to be substantially resilient to provide resilient deflection toward or away from the assembly axis A-A. The positioning elements 240*a*, 240*b* are preferably unitarily formed with the legs 232*a*, 232*b*, 232*c*. Each of the positioning elements are preferably formed as radiused bumps 240*a*, 240*b* which project radially outward for engaging the radiused grooves or recesses 228*a*, 228*b*, 228*c* of the inner surface 222 of the receiver 212 to couple the sprinkler receiver 212 and the frame 214.

In the assembly of the sprinkler 210, the legs 232*a*, 232*b*, 232*c* are inserted into distal end of the receiver passageway 224. A chamfer 223 can be formed at the distal end of the receiver to compress the legs 232*a*, 232*b*, 232*c* radially inward. The frame 214 is further inserted into the receiver to permit the bumps 240*a*, 240*b*, 240*c* to engage the recesses 228*a*, 228*b*, 228*c* and couple the receiver 212 and sprinkler frame 214 together. The engagement of the positional elements 228, 240 provides for relative rotational adjustment between the receiver and frame components 212, 214. The two or more recesses 228*a*, 228*b*, 228*c* formed and axially spaced along the inner surface 222 of the receiver 212 provide multiple positioning elements for engagement by the frame 214 to provide for axial adjustment.

The positioning elements or recesses 228 are axially located and formed along the inner surface 222 such that the engagement of the positioning elements 228, 240 between the receiver 212 and the sprinkler frame 214 facilitates formation of a fluid tight seal between components 212, 214. More preferably, the external surface 236 of the sprinkler frame 214 includes a groove formation 242 to house a sealing member 244, such as for example an o-ring. The groove 242 is preferably axially located along the external surface 236 such that the when the bumps 240*a*, 240*b*, 240*c* engage the recesses 228*a*, 228*b*, 228*c*, the seal member 244 engages a sealing surface 230 of the receiver to form the fluid tight seal. In an alternate configuration of the seal assembly, the inner surface 222 of the receiver 212 may define an internal groove for housing the seal element 244 and the external surface 236 of the sprinkler frame 214 may include a sealing surface for engagement with the seal element 144 to form the fluid tight seal. An exemplary illustration of the alternate sealing configuration is shown in FIG. 4A.

Figure 5:
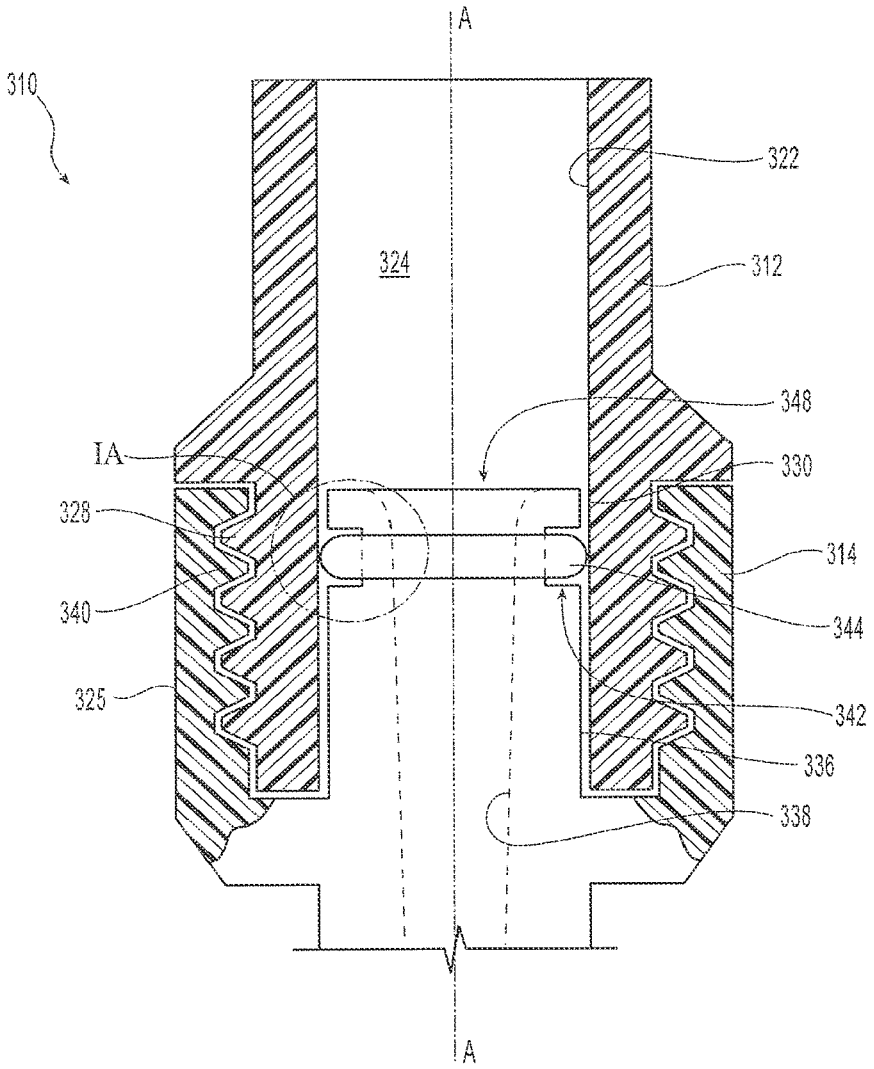
FIG. 5 is a detailed cross-sectional view of another embodiment of a coupling arrangement and sealing assembly of a sprinkler assembly.

The sprinkler assembly 10 of FIG. 1 includes internal threads 28 of the receiver 12 engaged with the external thread 40 of the sprinkler frame 14 which engage continuously about the assembly axis A-A as complimentary positioning elements to locate the seal assembly between the components 12, 14. An alternate configuration of positioning elements and sealing arrangement is shown in FIG. 5 in the sprinkler assembly 310. In the embodiment shown, the receiver 312 includes an internal surface 322 defining an internal passageway 324 and a positioning element in the form of a continuous external pipe thread 328 and more preferably a straight pipe thread 328 as described above. The proximal end of the sprinkler frame 314 is disposed within the receiver 312 placing the internal passageway 348 of the sprinkler frame in fluid communication with the receiver passageway 324. Surrounding the proximal portion of the frame 314 is a positioning element in the form of an internal thread of a collar 325 which is circumscribed about the proximal portion of the frame 314 having a positioning element as an internal thread 340 for engagement with the external thread 328 of the receiver 312. The sprinkler assembly 325 may have alternate cooperating positioning elements, for example, any one of the positioning element arrangements as previously described.

The illustrated threaded engagement between the components 312, 314 facilitates the fluid tight seal between the components by locating the seal assembly along the internal surface 322 of the receiver 312. Axially located along the external surface 336 of the proximal portion of the frame 314 within the collar 325 is a preferably annular groove 342. Disposed within the groove 342 is a sealing member 344, such as for example an o-ring for sealed engagement with a sealing surface 330 of the internal surface 322 of the receiver 312. In the formation of the assembly 310, the sprinkler frame 314 is threaded onto the receiver 312, so as to draw the proximal end of the sprinkler frame 314 into the passageway 324 which locates the o-ring 344 along the sealing surface 330. The sealing arrangement may be alternatively configured, for example, an internal groove may be formed along the internal surface 322 of the receiver 312 for housing the o-ring to be engaged with a sealing surface along an external surface 336 of the sprinkler frame, as seen for example in FIG. 1A.

Referring again to the illustrative embodiment of FIG. 1, the external surface 36 of the sprinkler frame preferably includes a step narrowing transition distal of the proximal portion to define a smaller width or diameter of the frame 14 that extends axially between the larger proximal and distal portions of the frame 14. The external surface 36 of the narrowed portion of the frame 14 can define a substantially non-circular geometry about the axis A-A. For example, the narrowed portion defines one or more flat surfaces 45, as seen for example about the axis A-A which can be used as a gripping surface or provide the clearance for operational components such as the deflector assembly pins described in greater detail below.

The internal surface 38 of the sprinkler frame 14 defines an internal passageway 46 that extends from the first end 32 to the second end 34. The passageway 46 of the sprinkler frame 14 preferably includes a proximal fluid passage 48 that is preferably contiguous, axially aligned, and in communication with the chamber 13 of the distal portion of the internal passageway 46. The threaded engagement between the receiver component 12 and the sprinkler frame 14 further axially aligns the internal passageways 24, 46 of the components placing them in communication with one another. The fluid passage 48 has an inlet 48*a* and outlet 48*b*. Further preferably included between the inlet and outlet 48*a*, 48*b* are a tapering portion that tapers narrowly in the distal direction and a constant diameter portion that is distal of and contiguous with the tapering portion. However the passageway the 48 may alternatively have a constant width or taper at a constant rate, variable rate or combinations thereof along its entire length.

The fluid passage 48, inlet 48*a* and outlet 48*b* preferably define a sprinkler constant or K-factor which approximates the flow rate to be expected from an outlet of a sprinkler based on the square root of the pressure of fluid fed into the inlet of the sprinkler. As used herein and the sprinkler industry, the K-factor is a measurement used to indicate the flow capacity of a sprinkler. More specifically, the K-factor is a constant representing a sprinkler's discharge coefficient, that is quantified by the flow of fluid in gallons per minute (GPM) through the sprinkler passageway divided by the square root of the pressure of the flow of fluid fed to the sprinkler in pounds per square inch gauge (PSTG.). The K-factor is expressed as $GPM/(PSI)^{1/2}$. Industry accepted standards, such as for example, the National Fire Protection Association (NFPA) standard entitled, "NFPA 13: Standards for the Installation of Sprinkler Systems" (2010 ed.) ("NFPA 13") provides for a rated or nominal K-factor or rated discharge coefficient of a sprinkler as a mean value over a K-factor range. As used herein, "nominal" describes a numerical value, designated under an accepted standard, about which a measured parameter may vary as defined by an accepted tolerance.

Figure 2B:
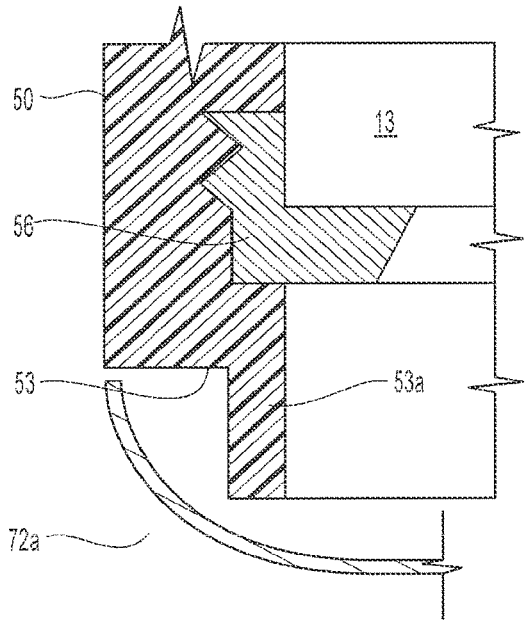
FIG. 2B is a detailed cross-sectional view of another embodiment of a sprinkler frame for use in the assembly of FIG. 1.

Because the chamber 13 is preferably configured to house operational components of the fire protection device, the chamber 13 provides for an expansion transition of the internal passageway 46 of the sprinkler frame 14 between the fluid passage 48 and the chamber 13. To enclose or frame the chamber 13, the external and inner surfaces 36, 38 together define an annular wall 50 circumscribed about the axis A-A. The external and inner surfaces further define a proximal edge 52 of the distal portion. The proximal edge 52 preferably extends radially about the axis A-A to further define a step wise transition of the external surface 36 between the narrowed portion and the enlarged distal portion. With reference to FIG. 2A, the external and inner surfaces 36, 38 define the distal edge 53 of the sprinkler frame 14, which faces the periphery of the thermally responsive plate assembly 72*a*. Shown in FIG. 2B is an alternate configuration of the distal edge 53, which provides for a distally extending portion 53*a* that extends parallel to the peripheral edge of the thermally responsive plate assembly 72*a*.

Upon actuation of the fire protection device, the deflector assembly is axially displaced from a first position within the chamber 13 to a second position preferably external of and distal of the chamber 13 as seen to one side of the axis A-A. In order to support a deflector assembly, the proximal edge 52 preferably includes one or more apertures for telescopically supporting the deflector assembly. Accordingly, the proximal edge 52 preferably includes one or more through holes 54. Preferably disposed for telescopic movement within the one or more through holes 54 are arm or pin members 62*a*, 62*b* of the deflector assembly 60 that are affixed to a deflector plate 64. The proximal edge 52 can include additional openings to house and support other operational components of a fire protection device. Other telescopic or non-telescopic deflector assemblies and operational components can be used with the preferred sprinkler frame 14 provided that the components can be housed and/or supported by the frame 14 such that the resultant device is satisfactorily effective in delivering and distributing a fire fighting fluid to address a fire.

Each of the receiver component 12 and sprinkler frame 14 are preferably constructed of and formed from a plastic material, more preferably, Chlorinated Polyvinyl Chloride (CPVC) material, more specifically CPVC material per ASTM F442 and substantially similar to the material used to manufacture the BLAZEMASTER® CPVC sprinkler pipe and fittings as shown and described in the technical data sheet, TFP1915: "Blazemaster CPVC Sprinkler Pipe and Fittings Submittal Sheet" (June 2008), which is incorporated by reference. The preferred plastic sprinkler assembly 10 is preferably configured for ease of installation in a fluid supply piping network. More specially, the plastic receiver component 12 preferably includes a reduced diameter at its first end 16 for insertion into and chemical boding with an appropriately sized CPVC fitting or pipe end. The outer surface at the first end 16 of the receiver component 12 can be alternatively configured for a different mechanical joint, for example, the end 16 can include an external thread for a threaded coupling.

In one preferred embodiment, the plastic sprinkler frame 14 is used in a concealed sprinkler arrangement in which an interior distal edge of the chamber 13 of the sprinkler frame 14 support two lever arms or members 70*a*, 70*b*. The lever arms 70*a*, 70*b* cooperate with the thermally sensitive plate assembly 72*a*, 72*b*, the deflector 64 and closure assemblies 80, 82 to house and/or substantially conceal the operational components within the chamber 13 of the sprinkler assembly 10 and support a static fluid pressure of about 500 psi. at the outlet of the fluid passage. In the particular embodiment of FIG. 1, the levers 70*a*, 70*b* support a plug 84 and bridge 86 which are engaged with the closure assembly 80, 82. The closure assembly preferably includes a mounting member 80 about which is disposed a spring seal 82 which is preferably biased away from the sealing surface formed at the outlet end 48*b* of the fluid passageway. In one embodiment, the spring seal 82 is a metallic annulus or disc member such as for example a Belleville spring.

In order to support such an arrangement and loading, the preferred plastic sprinkler frame 14 includes a metallic ring 56 embedded proximate the distal edge of the annular wall 50 forming the chamber 13. The preferred metallic ring 56 provides an L-shaped inner surface 56*a* upon which the levers members 70*a*, 70*b* can engage. The metallic ring 56 further preferably provides for a roughened or jagged outer surface 56*a* to facilitate the embedded engagement between the ring 56 and the plastic material of the sprinkler frame 14. Alternatively in the absence of the metallic ring, the sprinkler frame 14 and/or its annular wall may be made of a sufficiently rigid plastic to support the fluid pressure and load of the operational components.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A sprinkler assembly, comprising:

a receiver, comprising:

an inner surface extending from a proximal end to a distal end about a longitudinal axis, the inner surface tapering inwardly between the proximal end and the distal end to form a shoulder, the inner surface does not increase in inner diameter between the proximal end and the shoulder;

a stop surface at a distal portion of the shoulder;

a first thread extending from the stop surface and along the inner surface towards the distal end, the stop surface closer to the longitudinal axis than the first thread; and a sealing surface distal from the stop surface and having a greater inner diameter than the first thread; and a sprinkler comprising:

an internal surface to fluidly couple with the receiver;

an external surface opposite the internal surface, the external surface extending between a proximal portion and a distal portion;

a second thread of the external surface, the second thread to engage with the first thread to couple the sprinkler with the receiver, the stop surface is to contact a distal end of the distal portion of the external surface of the sprinkler thereby limiting movement of the sprinkler in a proximal direction relative to the receiver caused by rotation of the first thread with the second thread while the first thread is engaged with the second thread; and a groove in the proximal portion of the external surface, the groove between the second thread and a portion of the external surface narrower than the proximal portion and the distal portion.

2. The sprinkler assembly of claim 1, comprising:

a seal to be positioned between the receiver and the external surface, the seal located between the distal end and at least one of the first thread and the second thread during the engagement between the first thread and the second thread.

3. The sprinkler assembly of claim 1, comprising:

a seal in the groove to maintain sealing between the receiver and the sprinkler during rotation of the first thread relative to the second thread.

4. The sprinkler assembly of claim 1, comprising:

the receiver comprises at least one of a straight pipe nipple and an elbow.

5. The sprinkler assembly of claim 1, comprising:

the inner surface has a constant diameter from the proximal end to the tapering.

6. The sprinkler assembly of claim 1, comprising:

a conical portion of the inner surface forms the tapering.

7. The sprinkler assembly of claim 1, comprising:

the first thread and the second thread are straight pipe threads.

8. The sprinkler assembly of claim 1, comprising:

the sealing surface is longer than the groove.

9. The sprinkler assembly of claim 1, comprising:

the sprinkler is a concealed sprinkler.

10. A sprinkler assembly, comprising:

a passageway extending from a proximal end to couple with a pipe to a distal end to couple with a sprinkler, the passageway tapering inwardly between the proximal end and the distal end to form a shoulder, the passageway does not increase in inner diameter between the proximal end and the shoulder;

a stop surface at a distal portion of the shoulder;

a first thread extending from the stop surface and along the passageway towards the distal end;

a sealing surface between the stop surface and the distal end, the sealing surface having a greater inner diameter than the first thread; and a sprinkler body comprising an internal surface to fluidly couple with the passageway, and an external surface opposite the internal surface, the external surface extending between a proximal surface portion and a distal surface portion distal from the proximal end of the passageway relative to the proximal surface portion, the external surface having a second thread to engage with the first thread, the stop surface is to contact a distal end of the external surface of the sprinkler body thereby limiting movement of the sprinkler in a proximal direction relative to the passageway caused by rotation of the first thread with the second thread while the first thread is engaged with the second thread, the external surface having a groove in the proximal surface portion between the second thread and a portion of the external surface narrower than the proximal surface portion and the distal surface portion.

11. The sprinkler assembly of claim 10, comprising:
a seal to be received along the sealing surface.

12. The sprinkler assembly of claim 10, comprising:
at least one of a straight pipe nipple and an elbow.

13. The sprinkler assembly of claim 10, comprising:
the passageway has a constant diameter from the proximal end to the tapering.

14. The sprinkler assembly of claim 10, comprising:
a conical portion of the passageway forms the tapering.

15. The sprinkler assembly of claim 10, comprising:
the first thread is a straight pipe thread.

16. The sprinkler assembly of claim 10, comprising:
the passageway formed by a tubular fitting.

17. The sprinkler assembly of claim 10, comprising
the proximal end to form at least one of a mechanical bond and a chemical bond with a pipe.

* * * * *